US006364151B1

(12) United States Patent
Gale

(10) Patent No.: US 6,364,151 B1
(45) Date of Patent: Apr. 2, 2002

(54) CUP HOLDER

(75) Inventor: Gregory W. Gale, Napa, CA (US)

(73) Assignee: Regale Corporation, Napa, CA (US)

( * ) Notice: Subject to any disclaimer, the term of this patent is extended or adjusted under 35 U.S.C. 154(b) by 0 days.

(21) Appl. No.: 09/705,095

(22) Filed: Nov. 2, 2000

(51) Int. Cl.[7] ..... B65D 3/22

(52) U.S. Cl. ..... 220/738; 220/737; 220/739; 229/403

(58) Field of Search ..... 220/737, 738, 220/739; 229/403

(56) References Cited

U.S. PATENT DOCUMENTS

| | | | | | |
|---|---|---|---|---|---|
| 3,071,282 | A | * | 1/1963 | Walters | 220/738 |
| 3,262,626 | A | * | 7/1966 | Davis | 220/738 |
| 4,852,843 | A | * | 8/1989 | Chandler | 220/737 |
| 5,207,076 | A | * | 5/1993 | Sciarrillo | 220/737 |
| 5,285,953 | A | * | 2/1994 | Smith | 220/738 |
| 5,975,342 | A | * | 11/1999 | Bradeen et al. | 220/737 |
| 6,059,138 | A | * | 5/2000 | Labruyere | 220/737 |
| 6,068,182 | A | * | 5/2000 | Tokunaga | 220/738 |

* cited by examiner

*Primary Examiner*—Joseph M. Moy

(74) *Attorney, Agent, or Firm*—Flehr Hohbach Test Albritton & Herbert LLP

(57) ABSTRACT

A cup holder for receiving a hot beverage carrying a cup of the type with a rim with an open top and a closed bottom end with a tapered outwardly and upwardly extending side wall between the bottom end and the top rim. The side wall has an outer surface heated by the hot beverage in the cup. The cup holder comprises a single molded piece free of overlapping joints and free of adhesive and having at least three upstanding segments with each segment having upper and lower extremities. Hinges interconnect the three upstanding segments to retain the segments in a circular configuration with the segments being outwardly inclined to form a lower aperture which has a size substantially less than the size of the top rim of the cup and an upper aperture greater in size than the lower aperture permitting the cup holder to be nested before use. The hinges permit the lower extremity of the segments to be cammed outwardly as a cup is introduced through the upper aperture and through the lower aperture to engage the lower extremities of the segments and cam the lower extremities of the segments outwardly to thereby increase the size of the lower aperture to permit the cup to continue move therethrough and cam the upper extremities of the segments inwardly to come into frictional engagement with the side wall of the cup to frictionally retain the cup so that the cup is retained in the holder between the top rim and the bottom end.

9 Claims, 4 Drawing Sheets

CUP HOLDER

This invention relates to a cup holder and more particularly to a cup holder formed of molded fiber.

Cup holders have heretofore been provided to serve as thermal protectors for purchasers of hot beverages such as coffee or tea. Typically such cup holders are of a slip-over construction. One such cup holder is formed of corrugated paper which is die cut to provide a cooperative joint. It is also provided with an adhesive for adhesion to the cup after the cup holder has been opened and the cup slipped into the same. The glue typically is a low melt glue which is heated up by the hot beverage and serves to minimize or eliminate slippage of the cup holder on the cup. Such cup holders have been found to be objectionable because of the use of environmentally undesirable materials. There is therefore a need for a new and improved cup holder which overcomes these difficulties.

In general, it is an object of the present invention to provide a cup holder for cups carrying hot beverages which has a one-piece construction.

Another object of the invention is to provide a cup holder of the above character which is free of overlapping joints.

Another object of the invention is to provide a cup holder of the above character which is free of adhesives.

Another object of the invention is to provide a cup holder of the above character which is formed of molded fiber.

Another object of the invention is to provide a cup holder of the above character which has a low stacking pitch facilitating stacking of the holders before use.

Another object of the invention is to provide a cup holder of the above character in which the cup holder is provided with offset portions permitting the user's hands to remain comfortable while holding the cup with the cup holder.

Another object of the invention is to provide a cup holder of the above character which has ridges on its outer surface to facilitate grasping of the cup holder.

Another object of the invention is to provide a cup holder of the above character in which the cup holder is moved into firm frictional engagement with the cup when the cup is inserted into the cup holder.

Additional objects and features of the invention will appear from the following description in which the preferred embodiment is set forth in detail in conjunction with the accompanying drawings.

In general, the cup holder of the present invention is for receiving and retaining a hot beverage carrying cup of the type having a rim with an open top and a closed bottom end with a tapered side wall extending upwardly and outwardly between the bottom wall and the top rim with the side wall having an outer surface heated by the hot beverage in the cup. The cup holder comprises a single molded piece free of overlapping joints and free of adhesive. The piece has at least three upstanding segments with each segment having lower and upper extremities. Hinge means is provided interconnecting the at least three upstanding segments to retain the segments in a circular configuration with the segments being outwardly inclined to form a lower aperture which has a size substantially less than the size of the top rim of the cup and an upper aperture greater in size than the lower aperture permitting the cup holder to be nested before use. The hinge means permits the lower extremities of the segments to cammed outwardly as a cup is introduced through the upper aperture and through the lower aperture to engage the lower extremities to thereby cam the upper extremities inwardly and to come into frictional engagement with the side wall of the cup so that the cup is retained in the cup holder between the top rim and the bottom end. The segments are provided with portions which are spaced apart from the wall when the segments frictionally engage the wall so that said portions are spaced away from the heated surfaces of the cup permitting a user's hand to remain comfortable while holding the cup with the heated beverage therein.

Figure 1:
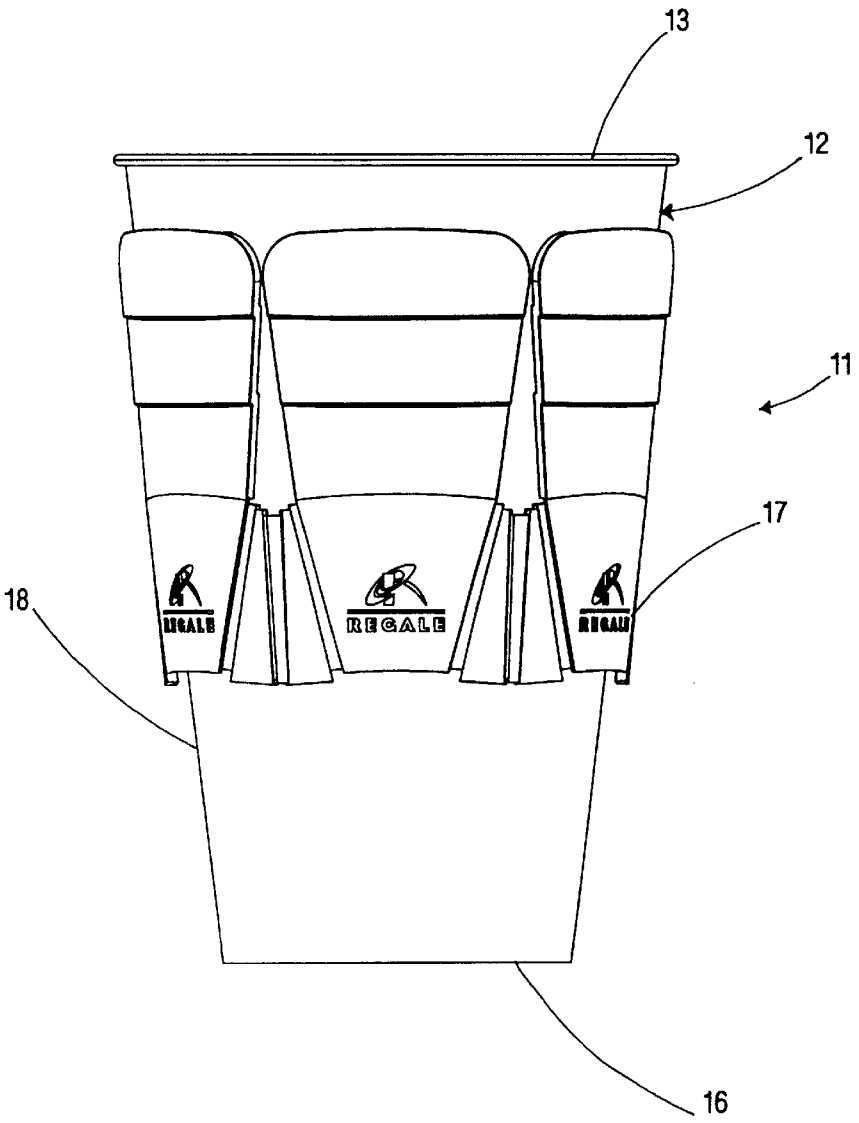
FIG. 1 is a side elevational view of a cup holder incorporating the present invention and showing the cup holder holding a cup.

More in particular, the cup holder 11 of the present invention is for holding a cup 12 of the type shown in FIG. 1 which is adapted to hold a hot beverage such as coffee or tea. The cup is provided with a top circular rim forming a top opening 14. The cup is also provided with a circular bottom planar wall or end 16 with a conically shaped side wall 17 extending from the bottom end upwardly and outwardly to the top rim 13. The side wall 17 is provided with an outer surface 18 which becomes heated when a hot beverage is within the cup 12. The cup 12 can be formed of a material suitable for containing hot beverages as for example plastic or a coated paper.

The cup holder 11 of the present invention is formed of a single piece 26 of molded pulp material. The molded pulp is of the type which is typically obtained from recycled newspapers, cardboard, corrugated cardboard boxes and the like. The one piece construction 26 shown in the drawings can be formed from molds in the manner described in co-pending application Ser. No. 09/385,914, filed Aug. 30, 1999. This single piece as shown is free of overlapping joints and is free of adhesives. It has at least three, as for example six upstanding segments 27 which have a petal-like configuration with each of the segments having upper and lower extremities 28 and 29. The segments 27 are provided with outwardly inclined side edges 31 and 32 that adjoin side edges 33 and 34 which are inclined outwardly at a lesser angle than the side edges 31 and 32 and are near vertical. The side edges 33 and 34 adjoin arcuate corners 36 which terminate in the upper extremity 28.

Hinge means 41 is provided for interconnecting the upstanding segments 27 to retain the segments in a circular configuration with the segments being outwardly inclined to form a lower aperture 42 which has a size substantially less than the size of the top rim of the cup and an upper aperture 43 which is of a size greater than the size of the lower aperture. The hinge means 41 in addition to interconnecting the segments 27 also serves to permit the lower extremities of the segments to be cammed outwardly as a cup is introduced to the upper aperture and through the lower aperture to engage the lower extremities of the segments and cam the lower extremities outwardly to thereby cam the upward extremities inwardly to come into frictional engagement with the side wall of the cup introduced therethrough whereby the cup is retained in the holder between the top rim and the bottom end.

Figure 2:
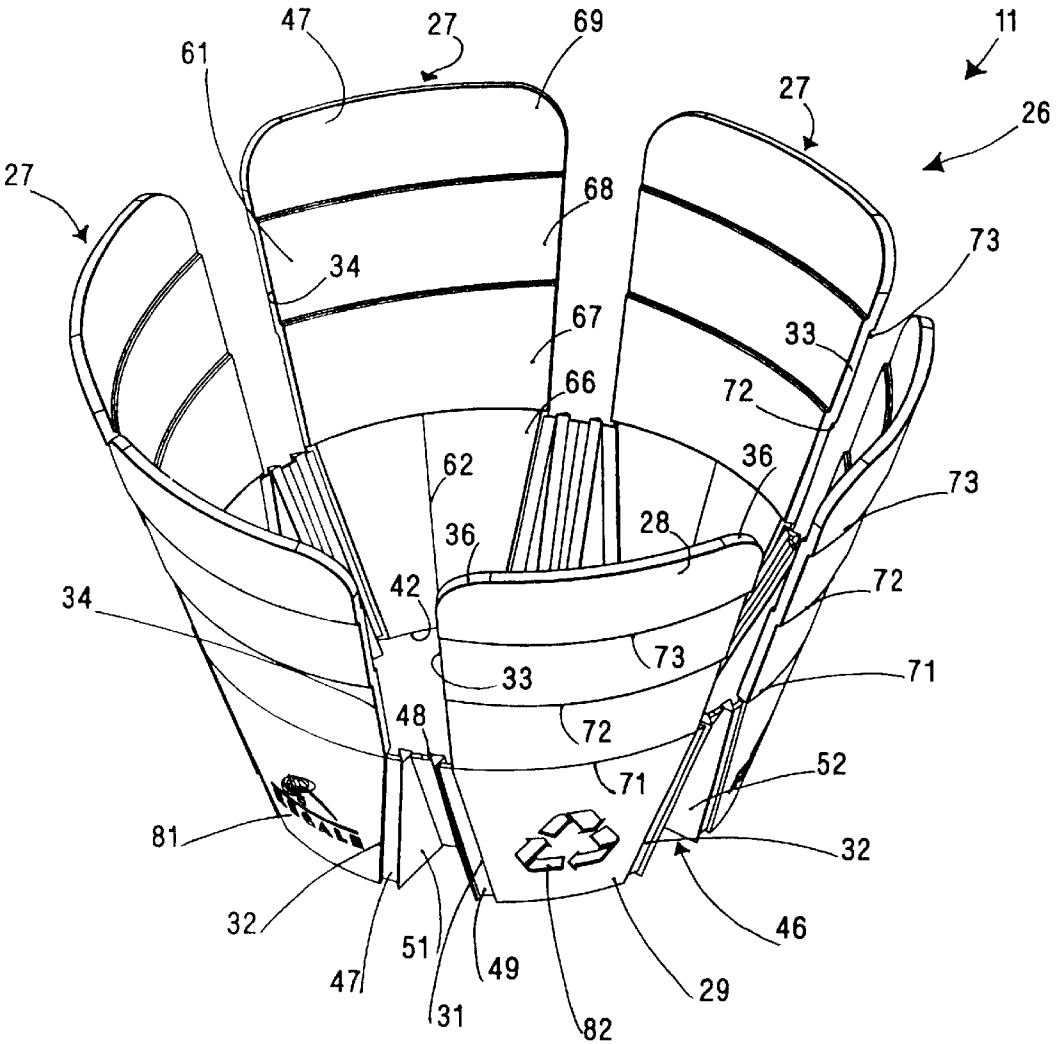
FIG. 2 is an isometric view of the cup holder shown in FIG. 1 before a cup is inserted into the cup holder.
Figure 3:
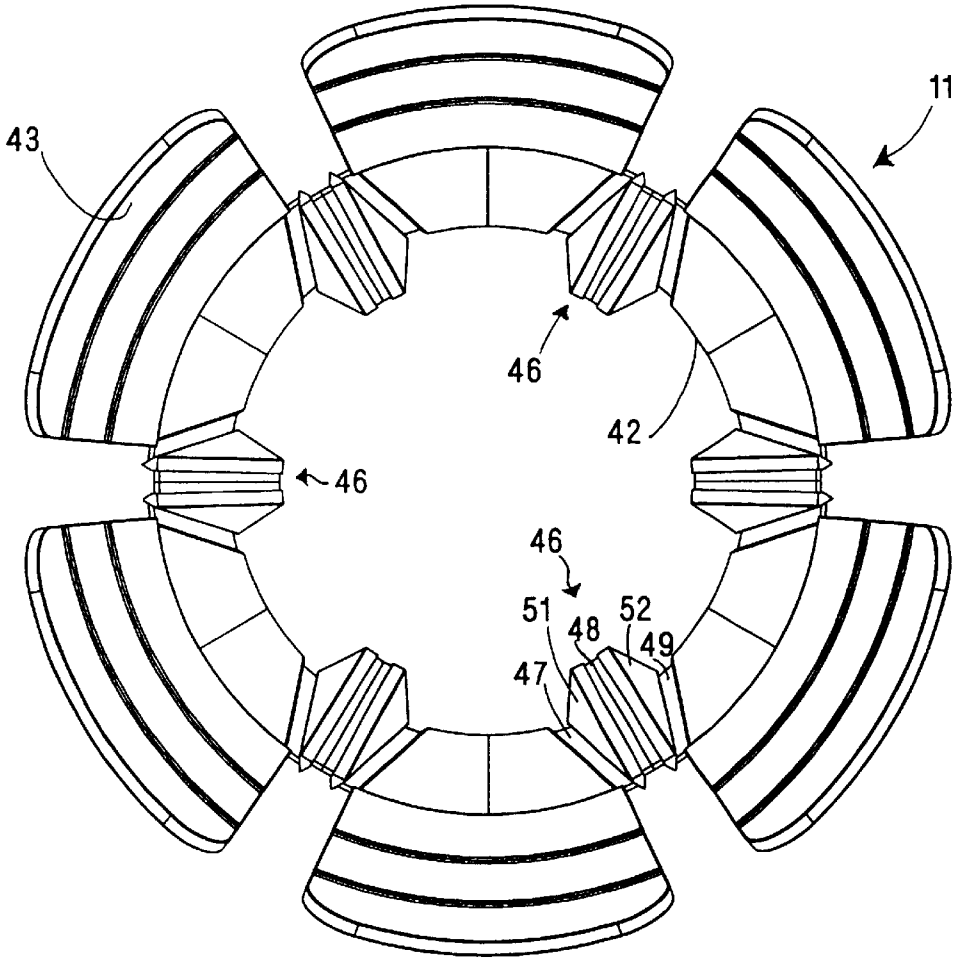
FIG. 3 is a top plan view of the cup holder shown in FIG. 2.

The hinge means 41 making this possible takes the form of a plurality of hinge assemblies 46 with one of the hinge assemblies 46 being provided between each two adjacent inclined side edges 31 and 32 of adjoining segments 27. Thus for at least three segments there would be at least three hinge assemblies 46. For the six segments shown on the cup holder 11, there are provided six hinge assemblies 46. Each of the hinge assemblies 46 consists of three separate hinges 47, 48 and 49 which are joined by triangular gussets 51 and 52 with gusset 51 adjoining hinges 47 and 48 and gusset 52 adjoining hinges 48 and 49. As can be seen particularly in FIGS. 2 and 3, the hinge assemblies 46 abut inwardly into the lower aperture 42 and are adapted to be engaged by the cup as the cup is inserted through the lower aperture as hereinafter described.

In order to better accommodate the cups 12, the cup holders 11 have segments 27 which are provided with arcuate inner surfaces 61 that conform generally to the curvature of the side wall 17 of the cup 12. This curvature is maintained from the upper extremity 28 to the lower extremity 29 of each of the segments with the curvature in the lower extremity being delineated from both sides of a vertically extending line 62.

Also in order to enhance the capabilities of the cup holder 11, the segments 27 are provided with a plurality of vertically spaced-apart portions spaced from the lower extremity 29 to the upper extremity 28 by portions 66, 67, 68 and 69. In accordance with the present invention at least one of the portions is offset with respect to the other portions. Thus, portion 68 is offset outwardly with respect to portion 67 and similarly portion 69 is offset outwardly with respect to portion 68. With such a construction, it is intended that portions 66 come into engagement with the side wall 17 of the cup whereas the portions 68 and 69 are spaced away from the heated surfaces of the side wall of the cup, permitting a user's hand to remain comfortable while holding the cup 12 in the cup holder 11. These same portions 67, 68 and 69 form ledges 71, 72 and 73 on the outer surfaces of the segments to enhance the grippability of the cup holder by the hands of the user rather than a single surface which could be slippery.

Figure 4:
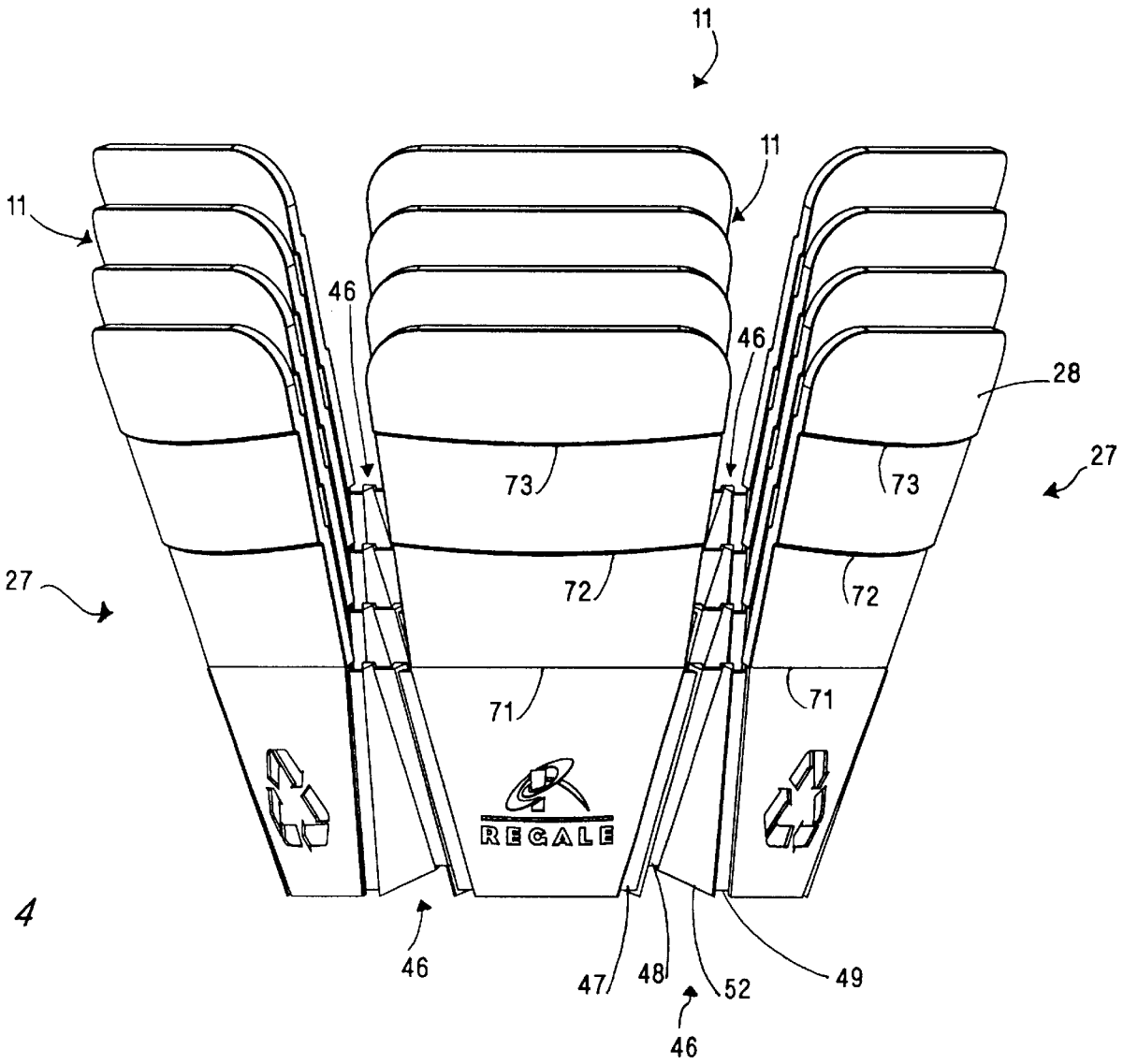
FIG. 4 is a side elevational view showing a plurality of the cup holders shown in FIGS. 2 and 3 in a nested or stacked relationship.

Another feature of the construction of the cup holder 11 is that the outwardly inclined segments 27 are inclined at an angle to provide a stacking pitch which is less than one-quarter of an inch. The appropriate angle from the vertical for the segments 27 can range from 15 to 25 degrees and preferably approximately 17 degrees. This permits a number of the cup holders to be stacked or nested in the manner shown in FIG. 4. This facilitates stacking of the cup holders in large numbers to facilitate packaging in shipping cartons for transporting from a factory to a user location.

Although the present invention has been described as being useful in connection with the use of only three segments, it is generally desirable to provide more segments as for example the six as shown to provide a cup holder which is more aesthetically pleasing. In addition by providing a greater number of segments there are provided a greater number of hinge assemblies 46 permitting the cup holder to be more flexible in accommodating the cups 12 received therein.

In making the cup holder 12 from molded fiber as hereinbefore described it has been found desirable to provide the piece 26 with a body having a wall thickness ranging from 0.060 to 0.085" and preferably approximately 0.070". The hinges 47 and 48 and 49 are formed of a thinner material to provide the desired hinge capabilities and preferably have a thickness of approximately one-half the thickness of the main body of the piece 26 as for example 0.03 to 0.425 and preferably from 0.35 to 0.40". Although the hinges 47, 48 and 49 are of a thinner material, the triangular gussets 51 and 52 are formed of a full thickness material as the body of the piece 26.

A trademark 81 and a logo 82 can be placed on the exterior surfaces of the cup holder 11 as shown in the drawings.

Operation and use of the cup holder 11 may now be briefly described as follows. Let it be assumed that the cup holders have been supplied in quantity in a nested or stacked relationship to a coffee shop to be utilized in connection with the dispensing of hot beverages such as coffee in cups 12. The unfilled cup 12 can be inserted into one of the cup holders 11 by lowering the cup 12 through the upper extremity 28 of the cup holder and pushing it downwardly through the lower aperture 42 while holding the cup holder 11 in the other hand. As the cup 12 moves downwardly, it comes into engagement with the hinge assemblies 46 and causes them to be cammed outwardly to permit increasing the size of the aperture 42 until the side wall 17 of the cup comes into engagement with the lower extremities 29 and the portions 66 of the segments 27. As this is occurring, the upper extremities 28 of the segments 27 are camed inwardly about the hinge assemblies 46 until the portions 67 frictionally engage the side wall 17 of the cup 12. During this relative movement between the cup 12 and the cup holder 11, the cup holder will be advanced upwardly along the side wall until it forms a snug frictional fit with the side wall 17. It then will be located at some distance above the lower extremity or bottom end 16 and below the top rim 13 and be frictionally located thereon in such a manner so that when the cup holder is held by the hand, the cup is retained by the cup holder in a fixed position with respect to the cup holder.

After the cup 12 has been so positioned in the cup holder 11, the user may grasp the upper extremity of the cup holder 11 as for example the upper portions 68 and 69 which are retained out of engagement with the side wall and then the cup can be filled with the hot beverage as for example coffee and then delivered to the customer. The customer can then pick up the cup by grasping the cup holder 11 around the upper extremities of the cup holder. Thus even though the beverage may be quite hot, the user can hold the cup holder comfortably because of the insulating capabilities of the molded fiber utilized for the cup holder and also because of the spacing of the segments 68 and 69 from the side wall of the cup serving to further insulate the user's hand from the heated surface 18 of the cup which has been heated by the hot beverage therein. After the user has drunk the hot beverage, the cup 12 and the cup holder 11 can be disposed of and recycled for another use.

Alternatively if it is desired, the user dispensing the hot beverage can first place the hot beverage in the cup 12 and thereafter position the cup holder 11 onto the cup in the manner hereinbefore described.

The ledges 71, 72 and 73 facilitate grasping of the cup holder by the user and helps to inhibit slipping of the cup holder and cup out of the hands of the user.

From the foregoing it can be seen that there has been provided a consumer friendly cup holder which is particularly useful for cups carrying hot beverages. The cup holder is constructed in such a manner that it will fit most different sizes of cups. With the offset construction utilized in the segments of the cup holders, it is possible to place certain portions of the cup holder in direct contact with the surface of the cup while the balance or remainder of the cup holder is spaced apart from the heated side wall of the cup and the customer's hand remains comfortable while holding the cup holder with the cup of heated beverage therein. The hinge assembly utilized for the connection of the segments is particularly efficacious in that it permits the cup holder to expand and accommodate various sizes of cups while at the same time providing a hinging action which when the lower extremities are cammed outwardly, the upper extremities are cammed inwardly to come into engagement with the side wall of the container to frictionally engage the same and to retain the cup within the cup holder so that the cup will not slip through the cup holder.

What is claimed:

1. A cup holder for receiving a hot beverage carrying a cup of the type with a rim with an open top and a closed bottom end with a tapered outwardly and upwardly extending side wall between the bottom end and the top rim, the side wall having an outer surface heated by the hot beverage in the cup, comprising a single molded piece free of overlapping joints and free of adhesive having at least three upstanding segments with each segment having upper and lower extremities, hinge means interconnecting the three upstanding segments to retain the segments in a circular configuration with the segments being outwardly inclined to form a lower aperture which has a size substantially less than the size of the top rim of the cup and an upper aperture greater in size than the lower aperture permitting the cup holder to be nested before use, said hinge means permitting the lower extremity of the segments to be cammed outwardly as a cup is introduced through the upper aperture and through the lower aperture to engage the lower extremities of the segments and cam the lower extremities of the segments outwardly to thereby increase the size of the lower aperture to permit the cup to continue to move therethrough and cam the upper extremities of the segments inwardly to come into frictional engagement with the side wall of the cup and to frictionally retain the cup so that the cup is retained in the holder between the top rim and the bottom end.

2. A cup holder as in claim 1 wherein said hinge means includes a plurality of hinge assemblies with a hinge assembly being disposed between each two adjacent segments.

3. A cup holder as in claim 2 wherein said molded piece is formed of a molded fiber and wherein each of said hinge assemblies includes a plurality of hinges formed of molded fiber but having a thickness which is less than the thickness of the remainder of the single piece.

4. A cup holder as in claim 3 wherein each of said hinge assemblies includes first, second and third hinges and wherein a gusset interconnects the first and second hinges and another gusset interconnects the second and third hinges.

5. A cup holder as in claim 3 wherein said hinge assemblies abut inwardly into the lower aperture.

6. A cup holder as in claim 1 wherein each segment is petal shaped.

7. A cup holder as in claim 1 wherein each segment is provided with vertically spaced apart portions at least one of said portions being offset with respect to another portion so that said another portion is in contact with the heated surface of the cup and the at least one portion is spaced outwardly from the heated surface of the cup permitting the user's hand to remain comfortable while holding the cup.

8. A cup holder as in claim 7 wherein each of said segments is provided with at least one ledge on its outer surface to facilitate grasping of the cup holder by the hand of the user to inhibit slipping of the cup holder through the hand of the user.

9. A cup holder as in claim 8 wherein the ridge is aligned with the offset portion.

* * * * *